US008632724B2

(12) United States Patent
Haidar

(10) Patent No.: US 8,632,724 B2
(45) Date of Patent: Jan. 21, 2014

(54) METHOD AND APPARATUS FOR FORMING TITANIUM-ALUMINIUM BASED ALLOYS

(75) Inventor: Jawad Haidar, Lindfield (AU)

(73) Assignee: Commonwealth Sci. and Ind. Res. Org., Campbell (AU)

( * ) Notice: Subject to any disclaimer, the term of this patent is extended or adjusted under 35 U.S.C. 154(b) by 299 days.

(21) Appl. No.: 12/988,884

(22) PCT Filed: Apr. 21, 2009

(86) PCT No.: PCT/AU2009/000501

§ 371 (c)(1),
(2), (4) Date: Dec. 22, 2010

(87) PCT Pub. No.: WO2009/129570

PCT Pub. Date: Oct. 29, 2009

(65) Prior Publication Data

US 2011/0091350 A1 Apr. 21, 2011

(30) Foreign Application Priority Data

Apr. 21, 2008 (AU) ..... 2008901946

(51) Int. Cl.
*C21B 7/00* (2006.01)

(52) U.S. Cl.
USPC ..... 266/177; 266/171

(58) Field of Classification Search
USPC ..... 266/170, 171, 176, 177
See application file for complete search history.

(56) References Cited

U.S. PATENT DOCUMENTS 2,745,735 A 5/1956 Byrns
3,004,848 A 10/1961 Hansley et al.

(Continued)

FOREIGN PATENT DOCUMENTS

DE 27 47 016 4/1978
EP 0 097 135 12/1983

(Continued)

OTHER PUBLICATIONS

U.S. Appl. No. 10/560,804, filed Dec. 15, 2005, pending.

(Continued)

*Primary Examiner* — Scott Kastler
(74) *Attorney, Agent, or Firm* — Neifeld IP Law, PC

(57) ABSTRACT

Disclosed herein are reactors and methods for forming alloys based on titanium-aluminium or alloys based on titanium-aluminium inter-metallic compounds. The reactor comprises a first section having an inlet through which precursor material comprising titanium subchlorides and aluminium can be introduced. The first section is heatable to a first temperature at which reactions between the titanium subchlorides and aluminium can occur, and further comprises a gas outlet via which any gaseous by-product formed can be removed. The reactor also comprises a second section which can be heated to a second temperature at which reactions of material transferred from the first section can occur to form the titanium-aluminium based alloy, a gas driver adapted in use to cause any gaseous by-product formed in the reactions in the second section to move in a direction towards the first section, and an intermediate section between the first and second sections. The intermediate section can be heated to an intermediate temperature at which at least a portion of material transferred from the first section can accrete and form a cake on a surface of the intermediate section and at which gaseous by-product formed in the reactions in the second section can be received and condensed. The reactor also comprises a removing apparatus for removing caked material from the surface of the intermediate section and transferring it to the second section.

10 Claims, 3 Drawing Sheets

(56) References Cited

U.S. PATENT DOCUMENTS

| | | | | |
|---|---|---|---|---|
| 3,252,823 | A | 5/1966 | Jacobson et al. | |
| 3,301,665 | A | 1/1967 | Timm et al. | |
| 3,450,525 | A | 6/1969 | Van Den Steen | |
| 3,455,678 | A | 7/1969 | Shapiro et al. | |
| 3,684,264 | A | 8/1972 | Petrov et al. | |
| 3,900,312 | A * | 8/1975 | Terry et al. | 75/676 |
| 4,437,888 | A | 3/1984 | Jecker | |
| 4,447,045 | A | 5/1984 | Kimura et al. | |
| 4,508,322 | A | 4/1985 | Kimura et al. | |
| 4,877,445 | A | 10/1989 | Okudaira et al. | |
| 4,902,341 | A | 2/1990 | Okudaira et al. | |
| 5,032,176 | A | 7/1991 | Kametani et al. | |
| 5,397,375 | A | 3/1995 | O'Donnell et al. | |
| 5,460,642 | A | 10/1995 | Leland | |
| 5,935,293 | A | 8/1999 | Detering et al. | |
| 2002/0184971 | A1 | 12/2002 | Myrick | |
| 2004/0050208 | A1 | 3/2004 | Nie et al. | |
| 2006/0191372 | A1 | 8/2006 | Haidar | |
| 2009/0165597 | A1 | 7/2009 | Haidar et al. | |

FOREIGN PATENT DOCUMENTS

| | | |
|---|---|---|
| EP | 0 134 643 | 6/1984 |
| EP | 0 298 698 | 1/1989 |
| GB | 754869 | 8/1956 |
| GB | 757873 | 9/1956 |
| GB | 1 516 257 | 6/1978 |
| GB | 1 566 363 | 4/1980 |
| GB | 2 158 102 | 11/1985 |
| JP | 52-32988 | 3/1977 |
| JP | 52-078608 | 7/1977 |
| JP | 64-15334 | 1/1989 |
| JP | 4-107234 | 4/1992 |
| JP | 2001192711 | 7/2001 |
| RU | 2 082 561 | 6/1997 |
| UA | 38454 A | 6/2001 |
| WO | 92/14851 | 9/1992 |
| WO | 2005/002766 | 1/2005 |
| WO | 2007/109847 | 10/2007 |

OTHER PUBLICATIONS

U.S. Appl. No. 12/225,552, filed Jan. 9, 2009, pending.
U.S. Appl. No. 13/514,990, filed Jun. 10, 2012, pending.
International Search Report for PCT/AU2009/000501, mailed Jun. 19, 2009.
T. Uda et al., "Contactless Electrochemical Reduction of Titanium (II) Chloride by Aluminum", Metalluroical and Materials Transactions B, vol. 31B, Aug. 2000—pp. 713-721.
International Search Report for PCT/AU2007/000385, mailed May 21, 2007.
International Preliminary Report on Patentability for PCT/AU2007/000385, dated Feb. 8, 2008.
Supplementary European Search Report for copending European Application EP 07 71 8632, completed Mar. 25, 2010, 1 page.
English Translation of Official Decision on Grant in corresponding Ukrainian Application No. a 2008 12511, issued May 14, 2010, 2 pages.
A.B. Murphy et al., "Equilibrium Calculation of the Reduction of Titanium Tetrachloride by Aluminum and Hydrogen", High Temp. Chem. Processes 3, Aug. 1994, pp. 365-374.
D. Hu, "Effect of boron addition on tensile ductility in lamellar TiAl alloys", Intermetallics 10, 2002, pp. 851-858.
Toru H. Okabe et al., "Reaction Pathways during Metallothermic Reduction of $TiCl_4$ by Utilizing Chemical Potential Diagrams", Titanium Extracting and Processing, 1997, pp. 133-151.
Carroll W. DeKock et al., "Attempted Preparation of Ti-6-4 Alloy Powders from $TiCl_4$, Al, $VCl_4$ and Na", Metallurgical Transactions B, vol. 18B, Sep. 1987, pp. 511-517.
R.W. Bartlett et al., "Titanium Powder by Magnesium Reduction of $TiCl_4$ in Liquid Zinc Alloy", Light Metals, 1994, pp. 1181-1186.
L. Lu et al., "The Mechanical Alloying of Titanium Aluminides", JOM, Feb. 2002, pp. 62-64.
N. Bertolino et al., "Ignition mechanism in combustion synthesis of Ti-Al and Ti-Ni systems", Intermetallics 11, 2003, pp. 41-49.
S.J. Gerdemann et al., "Titanium Aluminide Powder Production Via Reaction Between $TiCl_4$ and Al", Gamma Titanium Aluminides, 1999, pp. 341-346.
George Zheng Chen et al., "Direct electrochemical reduction of titanium dioxide to titanium in molten calcium chloride", Nature, vol. 407, Sep. 2000, pp. 361-364.
R.G. Reddy et al., "Thermodynamic properties of Ti-Al intermetallics", Journal of Alloys and Compounds 321, 2001, pp. 223-227.

* cited by examiner

METHOD AND APPARATUS FOR FORMING TITANIUM-ALUMINIUM BASED ALLOYS

This application is the U.S. national phase of International Application No. PCT/AU2009/000501, filed 21 Apr. 2009, which designated the U.S. and claims priority to Australian Application No. 2008901946, filed 21 Apr. 2008, the entire contents of each of which are hereby incorporated by reference.

TECHNICAL FIELD

The reactor and method disclosed herein can be used to form alloys based on titanium-aluminium or alloys based on titanium-aluminium inter-metallic compounds, and in particular low aluminium alloys based on titanium-aluminium or alloys based on titanium-aluminium inter-metallic compounds.

BACKGROUND TO THE DISCLOSURE

Titanium-aluminium (Ti—Al) alloys and alloys based on titanium-aluminium (Ti—Al) inter-metallic compounds are very valuable materials. However, they can be difficult and expensive to prepare, particularly in the powder form. This expense of preparation limits wide use of these materials, even though they have highly desirable properties for use in aerospace, automotive and other industries.

Reactors and methods for forming titanium-aluminium based alloys have been disclosed. For example, WO 2007/109847 discloses a stepwise method for the production of titanium-aluminium compounds and titanium alloys and titanium-aluminium inter-metallic compounds and alloys.

WO 2007/109847 describes the production of titanium-aluminium based alloys via a two stage reduction process, based on reduction of titanium tetrachloride with aluminium. In stage 1, $TiCl_4$ is reduced with Al in the presence of $AlCl_3$ to produce titanium subchlorides according to the following reaction:

$$TiCl_4+(1.333+x)Al \rightarrow TiCl_3+(1+x)Al+0.333AlCl_3 \text{ or} \quad (1)$$

$$TiCl_4+(1.333+x)Al \rightarrow TiCl_2+(0.666+x)Al+0.666AlCl_3 \quad (1)$$

In stage 2, the products from reaction (1) are processed at temperatures between 200° C. and 1300° C. to produce a powder of titanium-aluminium based alloys, according to the following (simplified) reaction scheme:

$$TiCl_3+(1+x)Al \rightarrow Ti—Al_x+AlCl_3 \text{ or} \quad (2)$$

$$TiCl_2+(0.666+x)Al \rightarrow Ti—Al_x+0.666AlCl_3 \quad (2)$$

SUMMARY OF THE DISCLOSURE

In a first aspect, there is provided a reactor for forming a titanium-aluminium based alloy. The reactor comprises:

- a first section comprising an inlet through which precursor material comprising titanium subchlorides and aluminium (e.g. aluminium powder or aluminium flakes) can be introduced, the first section being heatable to a first temperature at which reactions between the titanium subchlorides and aluminium can occur, the first section further comprising a gas outlet via which any gaseous by-product formed (e.g. gaseous aluminium chloride) can be removed;
- a second section which is heatable to a second temperature at which reactions of material transferred from the first section can occur to form the titanium-aluminium based alloy;

- a gas driver adapted in use to cause any gaseous by-product formed in the reactions in the second section (e.g. gaseous titanium chlorides) to move in a direction towards the first section (i.e. back out of the second section);
- an intermediate section between the first and second sections, the intermediate section being heatable to an intermediate temperature at which at least a portion of material transferred from the first section can accrete and form a cake on a surface of the intermediate section (e.g. on a wall of the intermediate section) and at which gaseous by-product formed in the reactions in the second section can be received and condensed; and
- a removing apparatus for removing caked material from the surface of the intermediate section and transferring it to the second section.

As used herein, the term "titanium-aluminium based alloy" is to be understood to encompass an alloy based on titanium-aluminium or an alloy based on titanium-aluminium intermetallic compounds.

As used herein, the term "titanium subchloride" is to be understood to refer to titanium trichloride $TiCl_3$ and/or titanium dichloride $TiCl_2$, or other combinations of titanium and chlorine, but not to $TiCl_4$, which is referred to herein as titanium tetrachloride. However, in some sections of the specification, the more general term "titanium chloride" may be used, which is to be understood as referring to titanium tetrachloride $TiCl_4$, titanium trichloride $TiCl_3$ and/or titanium dichloride $TiCl_2$, or other combinations of titanium and chlorine.

The present inventor has discovered that in the process disclosed in WO 2007/109847, the production of titanium-aluminium compounds etc may be hampered by the formation of sintered or hardened materials inside the reactor, which may hinder or prevent further movement of material through the reactor (in either direction). This hardening, which is also referred to herein as accretion, occurs as a result of the material crystallising to form large sintered solids at a certain temperature in the reactor. This problem may be further exacerbated by gaseous by-products, formed in a higher temperature region of the reactor, condensing on the hardened material.

Whilst the reactors disclosed in WO 2007/109847 have been used to produce titanium-aluminides such as γ-TiAl and $Ti_3Al$, under certain conditions (e.g. those required to form low aluminium titanium-aluminium based alloys) the reactors cannot be used for extended periods and therefore cannot reach steady state operation and produce materials with a uniform composition.

The inventor has found that the configuration of the reactor disclosed herein can advantageously enable the reactor to be operated for extended periods, whereby it can reach a steady state operation and produce materials having a uniform composition. In particular, the reactor disclosed herein can be used to form low aluminium titanium-aluminium based alloys in a steady state operation.

As used herein, the term "low aluminium titanium-aluminium based alloy", or the like, is to be understood to mean a titanium-aluminium based alloy containing less than about 10-15 weight percent of aluminium.

As used herein, the terms "titanium aluminides" and "titanium-aluminium intermetallic compounds", or the like, are to be understood to mean titanium-aluminium based alloys containing more than about 10-15 weight percent of aluminium. Alloys containing between about 10 wt % and 15 wt % of aluminium may be included in both categories of low aluminium titanium-aluminium alloys and titanium aluminides.

The removing apparatus may, for example, be an apparatus for shaking the intermediate section to dislodge the cake material from the surface, an apparatus for scraping the caked material from the surface, or an apparatus adapted to blow the caked material from the surface.

In some embodiments, the first section may be elongate, having respective ends proximal to the inlet and the intermediate section. In use, the first section is heated such that the temperature of the precursor material is increased to the first temperature as it passes from the inlet end to the intermediate section end. The first temperature may, for example, be in the range of about 300° C. to about 800° C.

In some embodiments, the second section may be elongate, having respective ends proximal to the intermediate section and a solid outlet. In use, the second section is heated such that the temperature of the material is increased to the second temperature as it passes from the intermediate section end to the solid outlet end. The second temperature may, for example, be above 800° C.

In some embodiments, the intermediate section may be elongate. The intermediate temperature may, for example, be between about 300° C. and about 800° C. at the end of the intermediate section proximal to the first section and between about 400° C. and about 900° C. at the end of the intermediate section proximal to the second section.

The inventor has found that when forming certain titanium-aluminium based alloys, materials moving through the reactor can accrete at temperatures between about 600° C. and 800° C. The accreted material can form a cake on surfaces within the reactor, which can clog the reactor and prevent further movement of material through the reactor. Accordingly, the temperature in the intermediate section is selected to span the range of temperatures at which accretion of the particular material is found to occur. Accreted material is then able to be removed from the surface of the intermediate section using the removing apparatus, thereby allowing movement of material to continue through the reactor.

In some embodiments, it may be desirable to minimise accretion and the intermediate section be adapted in use such that material is quickly transferred through the intermediate section (i.e. the material spends less time at temperatures where accretion can occur). For example, in some embodiments, the first and second sections may be elongate and substantially horizontal is use, whilst the intermediate section is elongate and substantially vertical in use. In such embodiments, the material quickly falls through the intermediate section due to gravity and accretion is minimised because minimal time is spent in the intermediate section at temperatures where accretion of the material can occur.

In some embodiments, the gas driver comprises a source of an inert gas and is adapted in use to cause the inert gas to pass into the second section and through the reactor in a reverse direction to the material and exit the reactor via the gas outlet. Gaseous by-products produced by the various reactions can thus be carried in the inert gas stream through the reactor in a reverse direction to the material, until they condense or are removed via the gas outlet.

The reactor typically further comprises moving apparatus (e.g. a rake-type apparatus, a screw or auger-type apparatus or a conveyor belt-type apparatus) operable to cause the material to be moved within the first section, transferred from the first section to the second section, and moved within the second section to the solid outlet and a collection vessel.

In some embodiments, the reactor may further comprise a primary reaction section in which reactions between titanium tetrachloride and aluminium may be caused to occur to form at least part of the precursor material. The primary reaction section is joined to the first section via the inlet so that reaction products from the primary reaction section (along with any other materials required to form the titanium-aluminium based alloy) can readily be added to the first section.

In some embodiments, the amount of aluminium in the titanium-aluminium based alloy is between 0.1% and 50% by weight.

Advantageously, the reactor of the first aspect can be used to form a low aluminium titanium-aluminium based alloy (i.e. a titanium-aluminium based alloy containing less than 10-15% (by weight) aluminium). Direct formation of low aluminium titanium-aluminium based alloys starting from titanium chlorides and aluminium using existing processes is not always possible.

In some embodiments, the titanium-aluminium based alloy may comprise titanium, aluminium and one or more additional elements. The one or more additional elements may be independently selected from the group consisting of chromium, vanadium, niobium, molybdenum, zirconium, silicon, boron, tantalum, carbon, tin, hafnium, yttrium, iron, copper, nickel, oxygen, nitrogen, lithium, bismuth, manganese and lanthanum.

For example, the titanium-aluminium based alloy may be based on any one of the systems of a Ti—Al—V alloy, a Ti—Al—Nb—C alloy, a Ti—Al—Nb—Cr alloy or a Ti—Al—$X_n$ alloy (i.e. the alloy includes n additional elements X), wherein n is less than 20 and X is an element selected from the group consisting of chromium, vanadium, niobium, molybdenum, zirconium, silicon, boron, tantalum, carbon, tin, hafnium, yttrium, iron, copper, nickel, oxygen, nitrogen, lithium, bismuth, manganese and lanthanum.

In a second aspect, there is provided a method for forming a titanium-aluminium based alloy. The method comprises the steps of:

- heating a precursor material comprising titanium subchlorides and aluminium up to a first temperature at which reactions between the titanium subchlorides and aluminium (e.g. aluminium powder or aluminium flakes) occur, and removing any gaseous by-product formed;
- moving the resultant material into an intermediate zone in which the material is heated to a temperature at which at least a portion of the material can accrete and form a cake on a surface (e.g. a wall) located in the intermediate zone;
- moving non-caked material out of the intermediate zone and heating the non-caked material to a second temperature at which reactions to form the titanium-aluminium based alloy occur, whilst transferring any gaseous by-product formed to the intermediate zone where it can condense and mix with any cake on the surface; and
- periodically removing the caked material from the surface in the intermediate zone and heating it with the non-caked material to the second temperature.

In some embodiments, the caked material is removed from the surface in the intermediate zone by scraping from the surface.

In some embodiments, the gaseous by-product formed with the titanium-aluminium based alloy is transferred to the intermediate zone by driving an inert gas in a reverse direction to the movement of the material.

In some embodiments, the material is quickly moved through the intermediate zone (e.g. by gravity) to minimise accretion.

In some embodiments, at least part of the precursor material is formed in a reaction between titanium tetrachloride and aluminium that is caused to occur before the precursor material heating step.

The titanium-aluminium based alloys formed in the method of the second aspect may be any of the titanium-aluminium based alloys described above with reference to the first aspect.

In some embodiments of the method of the second aspect, the titanium-aluminium based alloy is formed using the reactor of the first aspect.

In a third aspect, there is provided a titanium-aluminium based alloy formed using the reactor of the first aspect or the method of the second aspect.

As will be appreciated by those skilled in the art, the reactor and method described above may find broader application than for use in forming titanium-aluminium based alloys. Accordingly, in a further aspect, there is provided a reactor comprising:

- a first section in which material is heatable to a first temperature;
- a second section in which material is heatable to a second temperature; and
- an intermediate section between the first and second sections, whereby, in use, material is passed from the first section to the second section and material within the intermediate section is at a temperature at which by-products are formed, the by-products being removable from the intermediate section.

In a further aspect, there is provided a reactor for forming a titanium alloy, the reactor comprising:

- a first section comprising an inlet through which precursor material can be introduced, the precursor material being heatable in the first section to a first temperature;
- a second section in which material is heatable to a second temperature; and
- an intermediate section between the first and second sections, whereby material within the intermediate section can be heated to a temperature at which by-products can be formed and removed from the intermediate section.

In yet a further aspect, there is provided a method for forming a titanium alloy, comprising the steps of:

- heating a precursor material up to a first temperature at which undesirable by-products may start to form;
- moving the material into a zone in which the material is further heated to a temperature to form the undesirable by-products;
- moving the material out of the zone; and
- further heating the resultant material to a second temperature, at which the titanium alloy is formed.

BRIEF DESCRIPTION OF THE DRAWINGS

Preferred forms of the reactor and method set forth in the Summary will now be described, by way of example only, with reference to the following drawings, in which.

DETAILED DESCRIPTION

Figure 1:
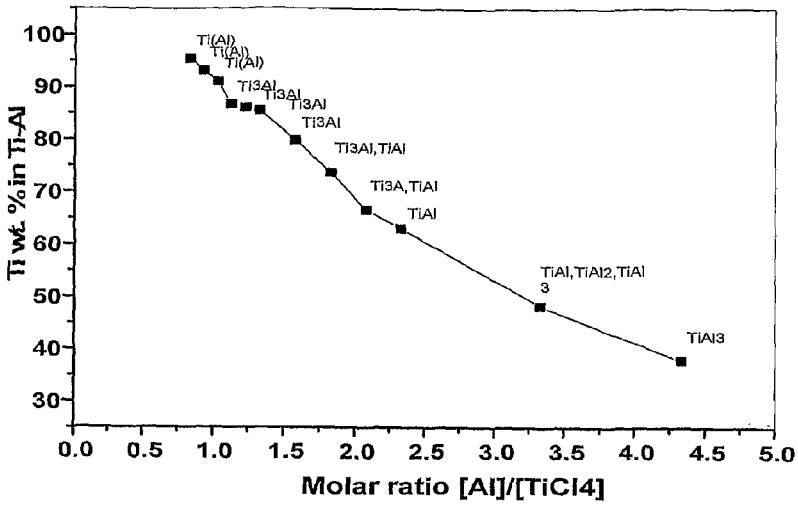
FIG. 1 shows a graph illustrating the Ti concentration (wt. %) of various Ti—Al alloys as a function of the [Al]/[$TiCl_4$] ratio in the starting material when the method disclosed in WO 2007/109847 was carried out in batch mode.

As described above, titanium-aluminium based alloys may be produced via a two stage reduction process, based on reduction of titanium tetrachloride with aluminium. In a primary reaction stage (e.g. stage 1 disclosed in WO 2007/109847), $TiCl_4$ is reduced with Al (optionally in the presence of $AlCl_3$) to produce titanium subchlorides according to the following reaction:

$$TiCl_4+(1.333+x)Al \rightarrow TiCl_3+(1+x)Al+0.333AlCl_3 \text{ or} \quad (1)$$

$$TiCl_4+(1.333+x)Al \rightarrow TiCl_2+(0.666+x)Al+0.666AlCl_3 \quad (1)$$

This reaction may be carried out at temperatures below 200° C. at 1 atm. The reaction is preferably carried out at temperatures below 150° C., and more preferably at temperatures below the boiling point of $TiCl_4$ (136° C.).

In stage 2, precursor material in the form of the products of reaction (1), with the addition of additional aluminium (e.g. aluminium powder or aluminium flakes) if required, are processed at temperatures between 200° C. and 1300° C. (preferably between 200° C. and 1000° C.), leading directly to the production of titanium-aluminium based alloys, according to the following (simplified) reaction scheme:

$$TiCl_3+(1+x)Al \rightarrow Ti—Al_x+AlCl_3 \text{ or} \quad (2)$$

$$TiCl_2+(0.666+x)Al \rightarrow Ti—Al_x+0.666AlCl_3 \quad (2)$$

The thermodynamics and kinetics of reactions between $TiCl_2$ and Al is similar to reactions between $TiCl_3$ and Al. Hereinafter, for simplicity, a simplified form of reaction (2) will be used:

$$TiCl_3+(1+x)Al \rightarrow Ti—Al_x+AlCl_3 \quad (3)$$

The reactor of the first aspect and method of the second aspect set forth in the Summary relate to stage 2 of this process. In embodiments in which the reactor further comprises a primary reaction section, the stage 1 reactions (i.e. reactions between titanium tetrachloride and aluminium to form at least part of the precursor material) can be performed in the primary reaction section. Similarly, these reactions can be caused to occur before the precursor material heating step in some embodiments of the method of the second aspect set forth in the Summary.

The aluminium content of the resulting titanium-aluminium based alloy can be determined by the amount of aluminium in the starting materials. FIG. 1 presents results showing the Ti content in the resultant alloy (produced in batch mode using the method disclosed in WO 2007/109847) as a function of the molar ratio of [Al]/[$TiCl_4$] in the starting materials of reaction 1. The Al used was in the form of a powder with particles of less than 15 μm. FIG. 1 shows that the aluminium content in the resultant alloy (the Al content is equal to 100−the Ti content) can be varied from a few percent, such as for low aluminium Ti—Al based alloys, through to titanium aluminides such as γ-TiAl. The results shown in FIG. 1 also include the phase composition of the Ti—Al alloys produced, and this composition is in agreement with published binary phase diagram for the Ti—Al system.

Titanium-aluminium based alloys with an Al content less than 10 to 15 wt % can be obtained only if the Al content in the starting materials is below the normal stoichiometric conditions required for reaction 2. For alloys with less than 6 wt % Al, the ratio [Al]/[$TiCl_4$] in the starting materials is below 60%. If the starting materials of reaction 1 were processed without any recycling, then a maximum 60% of the available $TiCl_4$ can react, and the remaining 40% would remain in a titanium chloride form. As a result, the corresponding single-pass yield would then be around 50%. The remaining 50% would need to be collected and recycled. Here, single pass yield is defined as the ratio of the amount of titanium in the produced alloy to the amount of titanium in the starting $TiCl_4$.

As can be seen from the results in FIG. 1, the composition of the resultant titanium-aluminium based alloy can be determined by adjusting amount of Al in the starting materials, which is illustrated in FIG. 1 through the molar ratio of aluminium to titanium tetrachloride [Al]/[$TiCl_4$].

For the production of titanium aluminides, the presence of a large amount of aluminium helps maximise reactions between titanium chlorides and aluminium and as a result the yield can be very high, nearing 100%. For example, for production of γ-TiAl, where the reaction is $TiCl_4$+2.333Al→TiAl+1.333$AlCl_3$, there are minimal losses and the starting materials should have a molar ratio [Al]/[$TiCl_4$] very close to the stoichiometric ratio of 2.333.

In order to produce titanium-aluminium alloys with an Al content less than 10 wt %, the molar ratio of [Al]/[$TiCl_4$] used in reaction 1 must be lower than the stoichiometric requirements of reaction 2, and the products of reaction 1 (i.e. the precursor material in the first section) must contain excess titanium chlorides. As the materials progress towards the high temperature zone of a reactor (e.g. the reactor disclosed in WO 2007/109847), the excess titanium subchlorides sublime and are blown (typically by being carried with an inert gas stream) towards the low temperature sections of the reactor where they re-condense and mix with a fresh stream of precursor materials moving through the reactor. As a result of this recycling of titanium subchlorides, the [Al]/[$TiCl_x$] ratio for material entering the high temperature zone decreases. The results in FIG. 1 suggest that this decrease in [Al]/[$TiCl_x$] should result in a lower concentration of aluminium in the resultant titanium-aluminium based alloy.

Whilst the recycling of titanium subchlorides would be expected to be inherent in the reactor, the inventor has found that, under some operating conditions (and particularly those where it is desirable to form low aluminium titanium-aluminium alloys), the recycling can be hampered by the sintering/hardening of materials inside the reactor as the materials in the reactor progresses towards the requirements for low Al alloys. The inventor has found that, under some operating conditions, materials moving through the reactor can harden at temperatures between 600° C. and 800° C., which can clog the reactor and prevent further movement of powder through the reactor tube. This hardening, hereinafter also referred to as accretion, occurs as a result of the materials in the temperature range of 600° C. to 800° C. crystallising to form large sintered solids.

Hardened materials in the accretion zone consist of a mixture of titanium subchlorides, Al, Ti and $TiAl_x$ particles. The mixture is pyrophoric and is difficult and dangerous to handle.

The inventor has also found that the titanium subchlorides evaporated from the material in the high temperature zone can also contribute to the build up of material because vapour emanating from the hot zone at temperatures higher than 800° C. recondenses in the lower temperature zone at temperatures less than 800° C. The recondensed materials can form a thick coating on the wall of the reactor or the accreted material, which can further hinder or prevent movement of the material within the reactor.

If the apparatus used to move materials within the reactor tube is prevented from moving by the hardened materials, processed alloy powder located in the high temperature zone of the reactor may remain at higher temperatures for excessive periods of time, leading to formation of large sintered metal sponges which further compounds the clogging problems.

The reactor and methods set forth in the Summary have been developed to overcome the hardening/sintering problems described above and enable the production of titanium alloys with a low Al content in a continuous mode. As described above, the reactor for forming a titanium-aluminium based alloy comprises first, intermediate and second sections, as well as a gas driver and a removing apparatus. Each of these components will now be described in more detail.

The first section comprises an inlet, through which precursor material comprising titanium subchlorides and aluminium (e.g. aluminium powder or aluminium flakes) can be introduced. The precursor material may be added directly to the first section via the inlet or, in embodiments in which the reactor further comprises a primary reaction section, the stage 1 reactions (i.e. reactions between titanium tetrachloride and aluminium which form at least part of the precursor material) described above can be performed in the primary reaction section and passed into the first section via the inlet (along with any other material necessary to form the desired alloy).

The aluminium can be in the form of a powder having an approximate upper grain size of less than about 50 micrometers. Alternatively, the aluminium can be in the form of flakes having a thickness in one dimension of less than about 50 micrometers. Alternatively, large particle sized aluminium may be milled before being added to the first section, as will be described in more detail below.

It is also possible to include one or more source(s) of additional element(s) in the precursor material by mixing the source(s) of the additional element(s) with the titanium subchlorides and aluminium in order to obtain titanium-aluminium based alloys having a desired composition. However, in some embodiments, the source(s) of the additional element(s) may be introduced at different processing stages. For example, in some embodiments, the source(s) of the additional element(s) can be milled with the starting aluminium, as will be described in more detail below. In other embodiments, the source(s) of the additional element(s) is introduced in the primary reaction section (i.e. when reacting $TiCl_4$ with aluminium). In some embodiments, the sources(s) of the additional element(s) can be added to the material in the intermediate section or in the second section.

In embodiments where it is desired to form titanium-aluminium based alloys containing vanadium, for example, vanadium chloride ($VCl_4$) and/or vanadium subchlorides, such as vanadium trichloride ($VCl_3$) and/or vanadium dichloride ($VCl_2$) may be added to the precursor materials, and the resultant titanium-aluminium based alloy would include vanadium. For example, the alloy Ti-6Al-4V (i.e. a titanium with 6 wt % aluminium and 4 wt % vanadium, which because of its composition has improved metal properties such as better creep resistance, fatigue strength, and the ability to withstand higher operating temperatures), can be prepared.

The source of the additional element may, for example, be a metal halide, a metal subhalide, a pure element or another compound which includes the element (preferably metal halides and more preferably metal chlorides). The source may also include a source of other precursors containing a required alloy additive, depending upon the required end product. The source of the additional element can be in a solid, a liquid or a gaseous form. When the source of the additional element is halide based chemicals having properties similar to titanium subchlorides, the recycling process described herein for titanium subchlorides within the second and intermediate sections may also occur for the additional elements. For example, for production of Ti-6Al-4V, where vanadium trichloride is the source of the vanadium, $VCl_3$ and $VCl_2$ may behave in a way similar to $TiCl_3$ and $TiCl_2$, and recycling occurring within the reactor may include both titanium subchlorides and also vanadium subchlorides.

As noted above, the source(s) of the additional element(s) may be mixed with the starting titanium tetrachloride and Al precursor during milling of the Al powder. Milling of the Al powder may be carried out by dry milling dry Al powder with $AlCl_3$ surfactant (and, optionally, the other source(s) of the element(s)). The $AlCl_3$ is used as a catalyst and hence its use as a surfactant is quite useful as it enables the production of a fine powder of both Al and $AlCl_3$.

Alternatively, the Al powder can be milled under liquid $TiCl_4$ at room temperature. This can reduce the hazards associated with production of uncoated Al powder during the milling stage. Moreover, milling under $TiCl_4$ enables reactions between $TiCl_4$ and Al leading to formation of titanium subchlorides, hence, reducing the processing requirements for production of titanium subchlorides in reaction 1 as discussed above.

In use, the first section is heated to a first temperature at which reactions between the titanium subchlorides and aluminium can occur. The reaction leaves a powder of Ti chemicals in the reaction zone containing a certain percentage of aluminium, as required for the end product. The first temperature will depend on the nature of the materials in the first section and the desired titanium-aluminium alloy, but will typically be in the range of between about 300° C. to about 800° C., preferably between about 400° C. to about 700° C., more preferably between about 450° C. to about 600° C.

The first section also has a gas outlet via which any gaseous by-product formed by heating the precursor material in the first section (e.g. gaseous aluminium chloride) can be removed. The gas outlet will also remove inert gas which may be driven through the reactor, as described below.

In some embodiments, the reactor may include multiple gas inlets adapted to prevent gaseous by-products within the reactor from reaching and damaging sealing parts located at various joints in the reactor The aluminium chloride removed from the first section can, if desired, be recycled for subsequent re-use (e.g. by condensing in a chamber following removal from the first section).

In some embodiments, the first section is elongate and has respective ends proximal to the inlet and the intermediate section. In use, the first section is heated such that the temperature of the precursor material is increased to the first temperature as it passes from the inlet end to the intermediate section end.

The reactor typically further comprises a moving apparatus operable to cause the material to be moved within the first section, transferred from the first section to the second section (i.e. via the intermediate section), and moved within the second section to a collection vessel. The moving apparatus typically enables a generally continuous flow of materials through the reactor. The moving apparatus may be any suitable apparatus for moving material through the first, intermediate and second sections, provided it is capable of withstanding the high operating temperatures. For example, the moving apparatus may be a rake-type apparatus (as described in further detail below), a screw (or auger)-type apparatus or a conveyor belt-type apparatus.

Depending on the arrangement of the first, intermediate and second sections, the reactor may require two or more moving apparatus to transfer the material from the inlet to an outlet. For example, the reactor may comprise a rake-type apparatus in the first section to move material from the inlet of the precursor materials to the exit of the first section at the intersection with the intermediate section, and a second rake in the second section to move material from the inlet of the second section at the intersection with the intermediate section towards an outlet in the second section, from which the titanium-aluminium alloy may be collected. In some embodiments, a third rake may be required to move material through the intermediate section.

In use, the second section is heated to a second temperature at which material transferred from the first section (via the intermediate section) can react to form the titanium-aluminium based alloy. The second temperature will depend on the nature of the materials in the second section and the desired titanium-aluminium alloy, but will typically be above 800° C., preferably above 900° C., more preferably above 950° C.

The reactions in the second section are mostly based on solid-solid reactions between titanium subchlorides and Al compounds. However, at temperature above 600° C., where titanium subchlorides can decompose and sublime resulting in the presence of gaseous species of $TiCl_4(g)$, $TiCl_3(g)$ and $TiCl_2(g)$, gas-solid reactions may occur between these species and Al-based compounds in the solid materials. For production of alloys with a high aluminium content, such as titanium aluminides, maximum temperatures in the second section of around 800° C. may be enough to complete the reactions between titanium chlorides and aluminium. However, this may result in a very fine produced alloy powder alloy and/or a high level of residual chlorine in the produced alloy powder. The reactions in the second section are therefore usually better carried out at higher temperatures to produce more consistent products. Apart from anything else, the reactions are somewhat slow when carried out at 600° C.

The reactor also has a gas driver for driving any gaseous by-product formed (e.g. gaseous titanium chloride) in the reactions in the second section in a direction out of the second section (i.e. in the direction of the first and intermediate sections). As the temperature in the intermediate section is cooler, any gaseous titanium chloride caught up in the gas stream will tend to condense in that section, as will be described in further detail below.

As the materials in the reactor are often pyrophoric and dangerous to handle, the gas driver will typically comprise a source of an inert gas (e.g. helium or argon) and be adapted to cause the inert gas to pass into the reactor via the second section (e.g. via a gas inlet located at a portion of the second section furthest from the intermediate section) and through the reactor in a reverse direction to the material, until it eventually exits the reactor via the gas outlet. This reverse gas flow may also increase the thermal conduction within that reaction zone.

Typically, the gas driver will be in the form of blower that blows the inert gas through the reactor. However, it will be appreciated that any mechanism for causing the gas to be driven out of the second section (e.g. mild pressure, sucking or convection) could be utilised.

In some embodiments, the second section is elongate and has respective ends proximal to the intermediate section and a solid outlet. In use, the second section is heated such that the temperature of the material is increased to the second temperature as it passes from the intermediate section end to the solid outlet end. The titanium-aluminium alloy produced in the reactor can be collected from the solid outlet in a collection vessel and allowed to cool.

The intermediate section is located between the first and second sections. In use, the intermediate section is heated to an intermediate temperature, at which material transferred from the first section can accrete and form a cake on a surface (e.g. a wall) of the intermediate section and at which any gaseous by-product formed in the reactions in the second section can be received and condensed.

The intermediate section is typically elongate and the intermediate temperature is between about 300° C. and about 800° C. (preferably between about 500° C. and about 700° C., more preferably about 600° C.) at the end of the intermediate section proximal to the first section and between about 400° C. and about 900° C. (preferably between about 500° C. and about 800° C.) at the end of the intermediate section proximal to the second section.

In some embodiments, it is desirable for the material in the reactor to pass quickly through the intermediate section, in order to minimise the time the material spends at a temperature where it can accrete. The material can be caused to be quickly passed through the intermediate section by any mechanism (e.g. a relatively fast moving apparatus), but in preferred embodiments, the first and second sections are elongate and substantially horizontal in use, and the intermediate section is elongate and substantially vertical in use. Material is thus quickly transferred by gravity from the first section to the second section via the intermediate section.

Finally, the reactor of the first aspect has a removing apparatus for removing the caked material from the surface (e.g. wall) of the intermediate section. The removing apparatus may be any apparatus operable to remove cake from the surface. For example, the removing apparatus may be an apparatus for shaking the intermediate section to dislodge the caked material from the wall (e.g. an ultrasonic vibrator), an apparatus for scraping the caked material from the wall (e.g. a moving or rotating scraper or blade), or an apparatus adapted to blow the caked material from the wall. The removing apparatus may also comprise a combination of any of these apparatus.

The removing apparatus may be operated manually by a user, or automatically using a computer.

In some embodiments, the removing apparatus may also comprise an apparatus adapted to quench gaseous titanium subchlorides entering the intermediate section from the second section, and prevent the vapour from depositing on the wall of the reactor.

Typically, the caked material removed from the surface in the intermediate section is transferred to the second section. The cake removed from the surface in the intermediate section comprises the accreted material and the condensed gaseous by-product formed in the reactions in the second section (e.g. titanium subchlorides). These materials are then able to further react together to form the titanium-aluminium alloy having the desired composition.

As those skilled in the art will appreciate, by periodically removing the cake from the wall of the intermediate zone, material cannot build up to a point where the reactor becomes blocked, and continuous operation of the reactor can therefore be achieved. Further, as the titanium chlorides are effectively recycled into the material entering the second section as described above, the reactor can be used for the continuous production of low aluminium titanium-aluminium alloys in a substantially continuous process.

It is within the skill of one skilled in the art to determine how often the cake needs to be removed from the surface of the intermediate section. This will depend on the nature of the materials in the reactor, the composition of the resultant alloy, and the operating temperatures.

The residence time of material in the respective sections of the reactor can be determined by factors known to those skilled in the art, such as the composition and properties of the required end products. For example, for titanium aluminides with a relatively high Al content, only a short residence time at the second temperature (e.g. 1000° C.) is required. However, for powdered products of low Al content, such as Ti-6Al, there is an excess of titanium subchlorides that need to be removed from the powder prior to proceeding towards the solids outlet. As a result more heat is required and the material needs to remain longer at 1000° C. to minimise the chlorine content in the resultant alloy.

The amount of aluminium in the titanium-aluminium based alloy which can be produced using the reactor of the first aspect set forth in the Summary, or the method of the second aspect set forth in the Summary may, for example, be between 0.1% and 50% by weight of the alloy or compound. As those skilled in the art will appreciate, such titanium-aluminium based alloys may be low aluminium (i.e. less than 10-15 wt %) titanium-aluminium alloys. In some embodiments, the alloy may comprise between 0.1 and 15 wt % Al, between 0.1 and 10 wt % Al, between 0.1 and 9 wt % Al, between 0.5 and 9 wt % Al, or between 1 and 8 wt % Al. In some embodiments, the alloy may comprise 0.5 wt %, 1 wt %, 2 wt %, 3 wt %, 4 wt %, 5 wt % 5 Wt %, 6 wt %, 7 wt %, 8 wt % or 10 wt % Al.

Titanium-aluminium based alloys which can be produced using the reactor of the first aspect set forth in the Summary or the method of the second aspect set forth in the Summary include titanium-aluminium-(one or more additional elements) based alloys (i.e. titanium-aluminium based alloys comprising titanium, aluminium and one or more additional elements). Such alloys may include titanium, aluminium and any other additional element or elements which one skilled in art would understand could be incorporated into the alloy, such as metallic or superconducting elements, for example. Typical elements include chromium, vanadium, niobium, molybdenum, zirconium, silicon, boron, tantalum, carbon, tin, hafnium, yttrium, iron, copper, nickel, oxygen, nitrogen, lithium, bismuth, manganese or lanthanum.

For example, the titanium-aluminium based alloy may be based on the system of a Ti—Al—V alloy, a Ti—Al—Nb—C alloy, a Ti—Al—Nb—Cr alloy or a Ti—Al—$X_n$ alloy (wherein n is the number of the additional elements X and is less than 20, and X is an element selected from the group consisting of chromium, vanadium, niobium, molybdenum, zirconium, silicon, boron, tantalum, carbon, tin, hafnium, yttrium, iron, copper, nickel, oxygen, nitrogen, lithium, bismuth, manganese or lanthanum).

Specific examples of titanium-aluminium based alloys which can be produced using the reactor of the first aspect set forth in the Summary or the method of the second aspect set forth in the Summary are: Ti-6Al-4V, Ti-10V-2Fe-3Al, Ti-13V-11Cr-3Al, Ti-2.25-Al-11Sn-5Zr-1Mo-0.2Si, Ti-3Al-2.5V, Ti-3Al-8V-6Cr-4Mo-4Zr, Ti-5AI-2Sn-2Zr-4Mo-4Cr, Ti-5Al-2.5Sn, Ti-5Al-5Sn-2Zr-2Mo-0.25Si, Ti-6Al-2Nb-1Ta-1Mo, Ti-6Al-2Sn-2Zr-2Mo-2Cr-0.25Si, Ti-6Al-2Sn-4Zr-2Mo, Ti-6Al-2Sn-4Zr-6Mo, Ti-6Al-2Sn-1.5Zr-1Mo-0.35Bi-0.1Si, Ti-6Al-6V-2Sn-0.75Cu, Ti-7AI-4Mo, Ti-8Al-1Mo-1V, or Ti-8Mo-8V-2Fe-3Al.

The titanium-aluminium based alloys produced using the reactor of the first aspect set forth in the Summary or the method of the second aspect set forth in the Summary may, for example, be in the form of a fine powder, an agglomerated powder, a partially sintered powder or a sponge like material. The product may be discharged from the solids outlet for further processing (e.g. to produce other materials). Alternatively a powder may be heated to make coarse grain powder, or compacted and/or heated and then melted to produce ingot. It is advantageous to produce titanium-aluminium based alloys in powder form. The powder form is much more versatile in manufacture of titanium-aluminium based alloy products, e.g. shaped fan blades that may be used in the aerospace industry.

Although not necessarily forming part of the method of the second aspect in its broadest form, it is useful to briefly describe how the precursor material comprising titanium subchlorides and aluminium may be formed in a reaction that is preliminary to the precursor material heating step. These reactions are essentially the same as those disclosed in WO 2007/109847.

In a primary reaction section, aluminium materials are introduced together with an appropriate quantity of $TiCl_4$ into a vessel to carry out the primary reactions (i.e. the reaction 1 set out above) for forming a titanium-aluminium based alloy. At the end of this reduction step, the remaining un-reacted $TiCl_4$ may be separately collected from the resulting solid precursor material of $TiCl_3$—Al—$AlCl_3$ for recycling. In some embodiments, the aluminium may also be thoroughly mixed with anhydrous aluminium chloride $AlCl_3$ just prior to being added to the $TiCl_4$. The advantages of using some $AlCl_3$ as a catalyst will be discussed in more detail shortly.

The mixture of $TiCl_4$ and Al, optionally with $AlCl_3$ as catalyst, is heated with an appropriate amount of Al so as to obtain an intermediate solid powder of $TiCl_3$—Al—$AlCl_3$. In some embodiments, the heating temperature can be below 200° C. In some embodiment, the heating temperature can even be below 136° C. so that the solid-liquid reactions between $TiCl_4$ and Al are predominant (i.e. below the boiling point of $TiCl_4$ of 136° C.). The mixture of $TiCl_4$—Al—$AlCl_3$ can be stirred in the first reaction zone whilst being heated so as the resulting products of $TiCl_3$—Al—$AlCl_3$ are powdery and uniform. By adding an amount of aluminium in excess of the stoichiometric amount required to reduce $TiCl_4$ to $TiCl_3$, all of the titanium tetrachloride can be reduced to form the resulting products of $TiCl_3$—Al—$AlCl_3$ which means that it may not be necessary to add any further aluminium to produce the precursor material for the reactor of the first aspect set forth in the Summary or method of the second aspect set forth in the Summary. In some embodiments, the $TiCl_4$ and/or the solid reactants of Al and optionally $AlCl_3$ are fed gradually into the reaction vessel. In all embodiments, sources of additional elements can be added to the starting $TiCl_4$—Al—$AlCl_3$ mixture.

Apparatus that can be used to carry the preliminary reaction include reactor vessels that are operable in a batch or in a continuous mode at temperature below 200° C. Operating pressure in such a reactor can be a few atmospheres, but is typically around 1 atmosphere. Aluminium chloride has a sublimation point of around 160° C. and, as it is desirable to maintain aluminium chloride in solution, in some embodiments, the reactions are performed at about 160° C. Since aluminium chloride acts as a catalyst for the reaction between titanium chloride and aluminium, in such embodiments the inventor has found that, by maintaining the temperature below the sublimation point of aluminium chloride, a solid phase of aluminium chloride remains in the reaction zone to allow improved particulate surface reactions to occur, rather than being present in a gaseous form.

Figure 2:
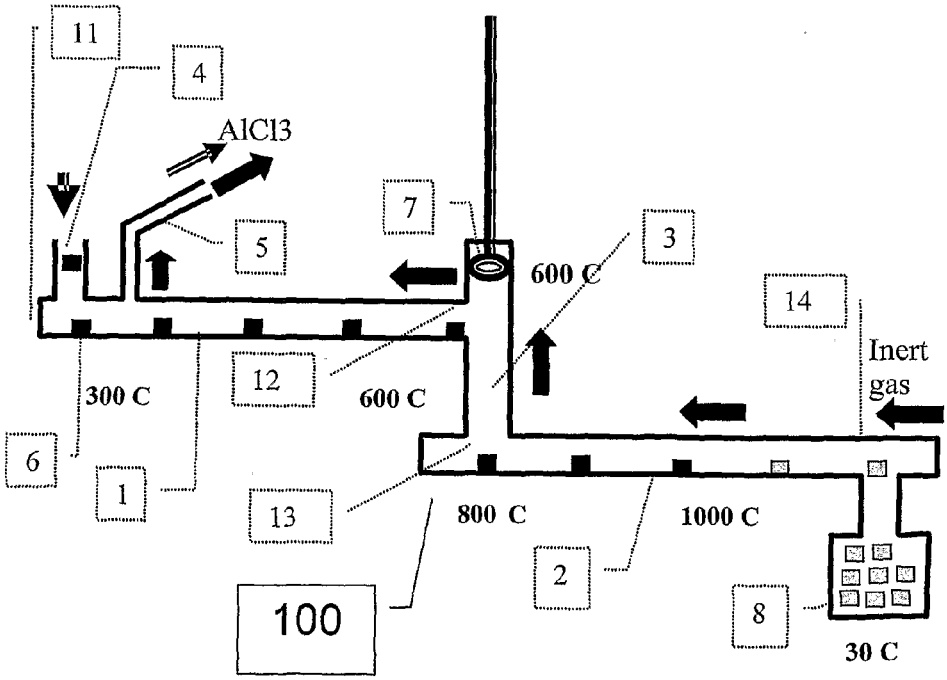
FIG. 2 shows a schematic diagram of a reactor in accordance with an embodiment of the reactor of first aspect set forth in the Summary.

An embodiment of the reactor of the first aspect set out in the Summary will now be described with reference to FIG. 2, which shows a reactor (100). The reactor (100) has been designed to overcome the hardening/sintering problems described above and hence allow for the production of titanium-aluminium based alloys with a low Al content (i.e. less than 10-15 wt %) in a continuous mode. The reactor is made of three sections; a first section (1), an intermediate section (3) and a second section (2).

The first section (1) consists of a horizontal tube positioned inside a furnace (not shown) capable of heating the tube to temperatures ranging from 30° C. at one end (11) (the left hand end in the Figure) to up to 800° C. at the other end (12) (the right hand end in the Figure). The first section (1) has an inlet port (4) which defines an entry point into the reactor (100) for precursor materials in the form of intermediate products $TiCl_3$—Al—$AlCl_3$ (6), which may be produced in a primary reaction section (not shown). The first section (1) also has a gas outlet in the form of gas vent (5), where gaseous by-products formed on heating the reactants in the various sections can exit the reactor (along with the inert gas described below).

Intermediate products $TiCl_3$—Al—$AlCl_3$ (6) enter the first section (1) of the reactor (100) through port (4) and are transported through the first section (1) using a rake (not shown) having a series of semi circular disc-scrapers fixed to a rod extending along the axis of the first section (as well as in the second section (2), as will be described below). The scrapers of the rake are semi-circular discs of a metal or an alloy with good resistance to attacks by chemical species present in the reactor (e.g. molybdenum or some grades of stainless steel) each fixed to the rod. In one particular embodiment, the rake may have a series of scrapers each separated from an adjacent scraper by a suitable (e.g. 40 mm) distance. Materials in the first section (1) can be moved by operating the rake in a reciprocal manner to scrape amounts of the material and its reaction products along the floor of the tube. In use, the rake is drawn axially outwardly in one direction (from end (11) towards end (12) in the Figure) and the scrapers are oriented downwardly so that each scraper can move a discrete amount of the material a short distance along the reactor floor. As the scrapers each reach their predetermined maximum travelling distance along the floor of the tube (i.e. 40 mm), the rod is rotated, thus rotating the scrapers so that they are each then oriented vertically upwardly. In this position, the scrapers are able to then be pushed axially inwardly into the reactor (from end (12) towards end (11) in the Figure) by a return travelling distance of 40 mm without contacting the material located on the reactor floor. The rod is then rotated so that the scrapers are once again oriented vertically downwardly and back into their starting position.

The process of moving the rake and its scrapers can then be repeated in a reciprocal manner, allowing for discrete transfer of materials from the inlet (4) towards an intermediate section (3). When the rake is being operated in a continuous reciprocal motion, the flow of materials through the reactor can be considered to be generally continuous. The frequency of these movements determines the residence time for the materials at the respective temperatures inside the reactor, depending on the required end product. The timing, speed and frequency of these movements can be automatically controlled by a control system. This system uses a computer which can be connected to a monitoring system which monitors some physical property of either the reactor or the reaction products to maximise the performance of the reaction.

The intermediate section (3) consists of a vertical tube, joining the exit of the first section (1) to the inlet of the second section (2). Materials are transported through intermediate section (3) due to gravity only, and therefore spend little time inside intermediate section (3). Intermediate section (3) also has a scrubbing unit with a ring type scraper (7), which is operable to move vertically inside the tube of intermediate section (3) to scrape materials which have deposited off the internal walls of intermediate section (3) and deposit them at the inlet of the second section (2) described below. The scraper is activated externally, for example by a user, using a handle.

The temperature of intermediate section (3) ranges from 300° C. to 800° C. (e.g. 600° C.) at its top part (12) (i.e. adjacent the exit of the first section (1)) to 400° C. to 900° C. (e.g. 800° C.) at the lower part (13) (i.e. adjacent the inlet of the second section (2)). Intermediate section (3) includes the temperature zone where accretion/hardening of material (6) can occur, and the geometrical configuration of the tube and scraper (7) enables removal of such hardened materials, the vertical scraper (7) being operable to continuously remove hardened materials off the wall.

Second section (2) consists of a horizontal tube positioned inside a furnace capable of heating the tube to temperatures ranging from 700-900° C. at its inlet (13) to more than 1000° C. in the central section of the tube. Material powder which has been processed in first section (1) and intermediate section (3) is transported though second section (2) of the reactor (for example using the rake mechanism described above), and the resultant titanium-aluminium based alloy is transferred to a dedicated collection vessel (8) located near the distal end (14) of the second section (2).

A gas driver (not shown) is used to blow an inert gas into the end (14) of the second section (2), which then flows through the reactor (100) in a direction opposite to the movement of the powder (i.e. through the second section (2), intermediate section (3) and first section (1), where it exits the reactor (100) via the gas vent (5)). The inert gas flow rate must be high enough to prevent diffusion of gaseous chlorine-based species in the direction of the material flow, and to cause titanium subchlorides evaporated from the high temperature zone in the second section (2) to be carried by the inert gas stream into regions with a lower temperatures where they can recondense. The titanium subchlorides evaporated from the high temperature zone mostly condense in intermediate section (3), where they are mixed with fresh materials moving towards the high temperature region of the reactor as well as materials scraped from the wall of the intermediate section (3), where they can again react. In this manner, the proportion of titanium in the material is caused to increase, facilitating the formation of low aluminium titanium-aluminium based alloys.

The concentration of Al in steady-state products depend on a combination of factors, including the amount of Al in the starting materials, flow rate of materials through the reactor, the temperature profiles of the reactor and losses associated with disproportionation reactions in the second section (2) of the reactor.

Another way to assist in minimising accretion/hardening in the intermediate section (3) would be to quench the gaseous titanium subchlorides at the bottom of the intermediate section (3) as it exits the second section (2) (i.e. at (13)). Quenching causes the gaseous titanium subchlorides to form a powder that is readily mixed with the incoming stream of fresh materials falling vertically downwards in the intermediate section (3).

As will be appreciated, the reactor (100) provides a number of advantages over existing reactors for forming titanium-aluminium based alloys. For example, the reactor (100) enables continuous recycling of excess titanium chlorides, and allows for starting materials with a [Al]/[$TiCl_4$] ratio close to 1.33 (the stoichiometric ratio for production of pure Ti) to be used as precursor materials for preparing titanium-aluminium based alloys with a low Al content. This process may also remove the need to separately collect and recycle $TiCl_3$, simplifying the overall process and allowing the yield to increase from around 50% in a batch mode operation to more than 90% in the continuous reactor.

The reactor (100) also allows for a better control over experimental parameters affecting properties of the end products for all titanium-aluminium based alloys, including titanium aluminides. For example, materials can be processed with different residence times in the first section (1) and second section (2), allowing for optimisation of the reactions at various temperatures within the reactor. For titanium aluminides, for example, the reaction between $TiCl_x$ and Al may need high temperature treatment at more than 900° C. for short residence times only to remove residual chlorides within the powder. The reactor (100) allows this treatment by regulating the temperature profiles in the first section (1), intermediate section (3) and second section (2), together with the corresponding residence times in the first section (1) and second section (2) so minimum processing time is spent in the second section (2) relative to first section (1).

For continuous production of low-Al alloys with less than 10-15 wt % Al and with a uniform composition, there is the requirement to operate with large quantities of materials and for extended times to reach steady state conditions with a constant composition of the end-products. The inventor has found that, for pre-steady state products obtained at the start of an experiment with a clean reactor, the aluminium content is relatively high, however, the aluminium content decreases over time as the recycling of $TiCl_3$ progresses towards stable operation with a constant ratio of [$TiCl_x$]:[Al]. These results are demonstrated in the following Figures.

Figure 3:
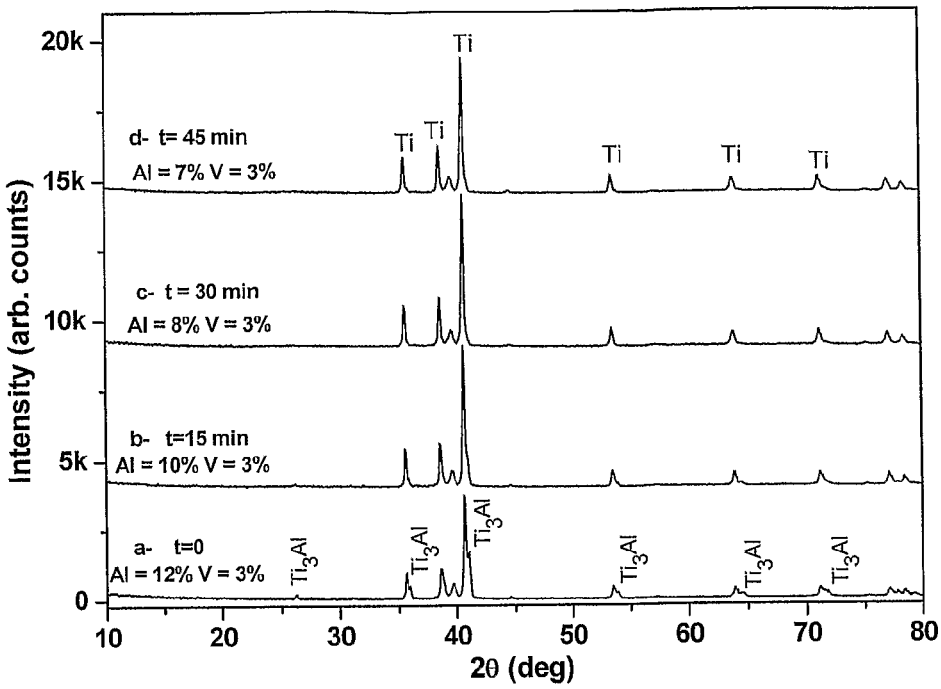
FIG. 3 shows XRD spectra for titanium-aluminium based alloys collected a) at the start of an experiment conducted with an embodiment of the reactor of first aspect set forth in the Summary, b) 15 minutes after the experiment started, c) 30 minutes after the experiment started, and d) 45 minutes after the experiment started (in which the starting materials included 434 mL of $TiCl_4$, 20 g of $VCl_3$ and 137 g of fine Al powder)

FIG. 3 shows X-ray diffraction (XRD) patterns for Ti—Al based powders produced at different times in an experiment which ran for 60 minutes starting with an empty unprimed reactor. Materials used here are precursor materials $TiCl_3$—Al—$AlCl_3$, with a ratio [Al]:[$TiCl_3$] equal to 1.03 (corresponding to 103% of the stoichiometric amount of Al required for the reaction $TiCl_3+Al \rightarrow Ti+AlCl_3$). The materials include $VCl_3$ in a ratio [$TiCl_3$]:[$VCl_3$] equivalent to 90:4.

The XRD patterns show that the intensity of lines corresponding to Ti(Al) (Al dissolved within the Ti) increases relative to lines corresponding to $Ti_3Al$, indicating that the Ti content in the end product increases with time. These results were confirmed by quantitative Energy Dispersive X-ray (EDX) analysis showing that the Al contents for materials corresponding to FIG. 4-(*a*), (*b*), (*c*) and (*d*) are 12 wt. %, 10 wt. %, 8 wt % and 7 wt. %, respectively. The vanadium content is around 3 wt %.

Figure 4:
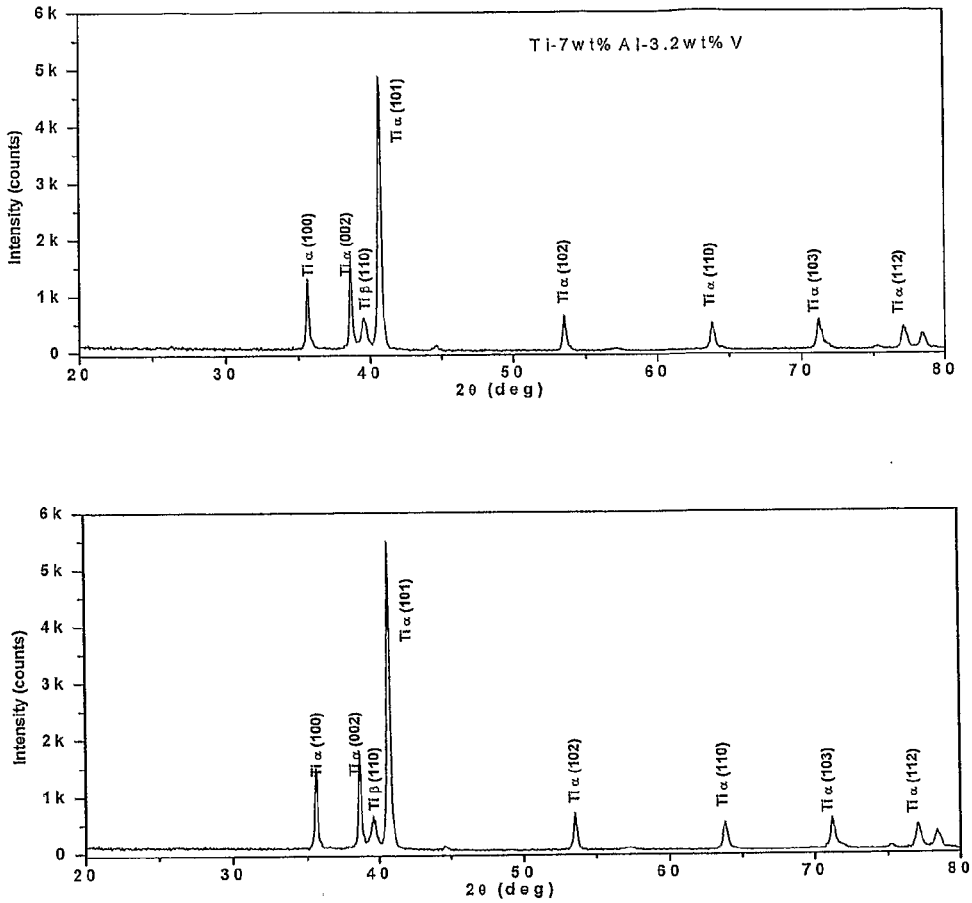
FIG. 4 shows XRD spectra for the alloy Ti—Al—V (Ti-7 wt % Al-3 wt % V) produced using an embodiment of the reactor of the first aspect set forth in the Summary and taken from the reactor at separate times.

After a steady state is reached, the composition of materials collected at the exit of the reactor becomes constant. FIG. 4 shows examples of XRD patterns for samples collected at separate times during steady state operation to produce a powder of Ti—Al—V. As can be seen, the XRD patterns are essentially the same.

In the claims which follow and in the preceding description of the invention, except where the context requires otherwise due to express language or necessary implication, the word "comprise" or variations such as "comprises" or "comprising" is used in an inclusive sense, i.e. to specify the presence of the stated features but not to preclude the presence or addition of further features in various embodiments of the invention.

A reference herein to a prior art document is not an admission that the document forms part of the common general knowledge in the art in Australia.

The invention claimed is:

1. A reactor for production of titanium-aluminium alloys, comprising:

a first section having an inlet through which precursor material containing titanium subehlorides and aluminium are introduced, the first section being heatable to a first temperature at which reactions between the titanium subchlorides and aluminium occur, the first section further comprising a first moving apparatus and a gas outlet via which any gaseous by-product formed in the reactor can be removed:

a second section which is heatable to a second temperature at which reactions of material transferred from the first section occur to form a titanium-aluminium based alloy, the second section further comprising a second moving apparatus;

a gas driver adapted in use to cause any gaseous by-product formed in the reactions in the second section to move in a direction towards the first section;

an intermediate section between the first and second sections, the intermediate section configured to be heatable to an intermediate temperature such that at least a portion of material transferred from the first section accretes on a surface of the intermediate section, the intermediate section also configured to receive gaseous by-product formed in the reactions in the second section such that the gaseous by-product is condensed in the intermediate section; and a removing apparatus for removing accreted material from the surface of the intermediate section and transferring it to the second section.

2. The reactor of claim 1, wherein the removing apparatus is an apparatus for shaking the intermediate section to dislodge the accreted material from the surface, an apparatus for scraping the accreted material from the surface, or an apparatus adapted to blow the accreted material from the surface.

3. The reactor of claim 1, wherein the first section is elongate, having respective ends proximal to the inlet and the intermediate section, whereby, in use, the first section is heated such that the temperature of the precursor material is increased to the first temperature as it passes from the inlet end to the intermediate section end.

4. The reactor of claim 1, wherein the second section is elongate, having respective ends proximal to the intermediate section and a solid outlet, whereby, in use, the second section is heated such that the temperature of the material is increased to the second temperature as it passes from the intermediate section end to the solid outlet end.

5. The reactor of claim 1, wherein the intermediate section is elongate.

6. The reactor of claim 1, wherein the first and second sections are elongate and substantially horizontal in use and the intermediate section is elongate and substantially vertical in use.

7. The reactor of claim 1, wherein the gas driver comprises a source of an inert gas, the gas driver being adapted in use to cause the inert gas to pass into the second section and through the reactor in a reverse direction to the material and exit the reactor via the gas outlet.

8. The reactor of claim 1, further comprising moving apparatus operable to cause the material to be moved within the first section, transferred from the first section to the second section, and moved within the second section to a collection vessel.

9. The reactor of claim 8, wherein the moving apparatus is a rake apparatus, a screw apparatus or a conveyor belt apparatus.

10. The reactor of claim 1, wherein the reactor further comprises a primary reaction section in which reactions between titanium tetrachloride and aluminium may be caused to occur to form at least part of the precursor material, the primary reaction section being joined to the first section via the inlet.

* * * * *